US010145344B2

(12) United States Patent
Park et al.

(10) Patent No.: US 10,145,344 B2
(45) Date of Patent: Dec. 4, 2018

(54) STRUCTURE OF GDI FUEL DELIVERY PIPE

(71) Applicant: DONGBO IND. CO., LTD., Incheon (KR)

(72) Inventors: See Woo Park, Incheon (KR); Su Hwi Lee, Incheon (KR); Su Jin Yu, Incheon (KR); Keun Sik Lee, Incheon (KR)

(73) Assignee: DONGBO IND. CO., LTD., Incheon (KR)

( * ) Notice: Subject to any disclaimer, the term of this patent is extended or adjusted under 35 U.S.C. 154(b) by 0 days.

(21) Appl. No.: 15/785,611

(22) Filed: Oct. 17, 2017

(65) Prior Publication Data

US 2018/0128223 A1 May 10, 2018

(30) Foreign Application Priority Data

Oct. 19, 2016 (KR) ..... 10-2016-0135804

(51) Int. Cl.

| | |
|---|---|
| ***F02M 55/02*** | (2006.01) |
| ***F02M 69/46*** | (2006.01) |
| ***F02M 55/00*** | (2006.01) |
| ***F02M 61/14*** | (2006.01) |

(52) U.S. Cl.

CPC ..... *F02M 55/005* (2013.01); *F02M 55/02* (2013.01); *F02M 55/025* (2013.01); *F02M 61/14* (2013.01); *F02M 69/465* (2013.01); *F02M 2200/315* (2013.01); *F02M 2200/8084* (2013.01); *F02M 2200/856* (2013.01); *F02M 2200/857* (2013.01)

(58) Field of Classification Search

CPC .... F02M 55/005; F02M 55/025; F02M 55/02; F02M 2200/857; F02M 69/465

USPC ..... 123/456, 469, 468, 470, 447

See application file for complete search history.

(56) References Cited

U.S. PATENT DOCUMENTS

2012/0138020 A1* 6/2012 Kweon ..... F02M 55/025 123/469

FOREIGN PATENT DOCUMENTS

| | | | | |
|---|---|---|---|---|
| DE | 102012208043 | * | 11/2013 | ..... F02M 61/14 |
| EP | 2492489 | A1 * | 8/2012 | ..... F02M 55/025 |
| JP | 2006-046138 | A | 2/2006 | |
| JP | 2010-007651 | A | 1/2010 | |
| KR | 10-2011-0003235 | A | 1/2011 | |
| KR | 10-2011-0133908 | A | 12/2011 | |
| KR | 201606495 | A * | 12/2014 | ..... F02M 55/02 |

(Continued)

*Primary Examiner* — Mahmoud Gimie

(74) *Attorney, Agent, or Firm* — KORUS Patent, LLC; Seong Il Jeong

(57) ABSTRACT

Disclosed herein is the structure of a GDI fuel delivery pipe. The structure of a GDI fuel delivery pipe includes: a main pipe configured to flow fuel through a hollow formed therein; a plurality of injector cups formed in cylindrical shapes having open lower ends, and configured to be coupled and fastened to the main pipe, to flow fuel therethrough, and to be coupled to respective injectors; a plurality of mount holders configured to form tubular parts each having a bolt hole in a lengthwise direction, and to be coupled and fastened to the main pipe; and fastening members configured to fasten the plurality of injector cups or mount holders to the main pipe by being coupled to the outer circumferential surface of the main pipe at both left and right ends thereof while surrounding the outer circumferences of the plurality of injector cups or mount holders.

1 Claim, 2 Drawing Sheets

(56) References Cited

FOREIGN PATENT DOCUMENTS

KR 10-2015-0048548 A 5/2015

* cited by examiner

STRUCTURE OF GDI FUEL DELIVERY PIPE

BACKGROUND

1. Technical Field

The present invention relates to the structure of a GDI fuel delivery pipe, and more specifically to the structure of a gasoline direct injection (GDI) fuel delivery pipe in which each of injector cups and mount holders coupled to a main pipe is constructed in at least two separate structures, and welded areas and locations are increased compared to conventional areas and locations, thereby improving repetition durability (pulsation fatigue durability) against variations in pressure.

2. Description of the Related Art

Recently, in order to meet regulation on exhaust gas which has been tightened all over the world, various technologies have been developed and actually applied.

Of these technologies, a gasoline direct injection (GDI)-type engine increases combustion efficiency by directly injecting high-pressure fuel into a combustion chamber, thereby reducing exhaust gas and also improving fuel efficiency and output. Accordingly, the development of this engine has been actively performed.

In connection with the GDI-type engine, high-pressure pumps configured to inject high-pressure fuel, and GDI injectors have been already developed by various famous companies. Furthermore, fuel rails configured to supply fuel to GDI injectors have been being developed in conformity with the mounting locations and spaces of individual engines.

In an engine which is called a multi-point injection (MPI) engine or a port fuel injection (PFI) engine and which is configured to inject fuel to an air intake port and an air intake valve, to mix the fuel with intake air, and supply mixture air to a combustion chamber, a low fuel pressure ranging from 3 to 5 bars is applied to a fuel rail. Accordingly, in the development of a fuel rail, emphasis is placed on the securement of reliability against vibration and fuel pulsation within the fuel rail, rather than the securement of strength against fuel pressure. In contrast, in the development of a GDI fuel rail to which a high fuel pressure ranging from 120 to 200 bars is applied, the securement of fatigue strength against pressure, vibration, and heat needs to take precedence.

Korean Patent Application Publication No. 10-2015-0048548 discloses a fuel rail for a vehicle, including: a hollow part configured to store fuel received from a fuel supply unit; a pipe configured to have distribution holes adapted to distribute fuel stored in the hollow part; injector cups configured to be inserted and installed into cylinder heads, to fasten injectors adapted to inject fuel into the cylinder heads, and to have fuel paths communicating with the distribution holes so that fuel distributed through the distribution holes can flow into the injectors; and mount holders configured to have bolt holes adapted to fasten the pipe to the cylinder heads; wherein the injector cups and the pipe, and/or the mount holders and the pipe are brazed to each other by using a filler material having a stainless steel-based component.

In the above-described conventional GDI-type fuel rail, the mount structures and the injector cups are independently constructed, and the individual structures are attached to the main pipe by using a brazing method (using a filler material).

Meanwhile, in the above-described conventional GDI-type fuel rail in which the mount structures and the injector cups are independently constructed and the individual structures are attached to the main pipe by using a brazing method, the fuel rail is subjected to displacement due to pressure, heat, or vibration generated in an engine, with the result that fatigue stress is imposed on the individual parts of the fuel rail. In particular, stress is concentrated on welded (brazed) portions of the mount structures and the injector cups fastened to the engine heads, and thus a problem occurs in that cracks occur in the welded portions.

SUMMARY

An object of the present invention is to provide the structure of a gasoline direct injection (GDI) fuel delivery pipe in which each of injector cups and mount holders coupled to a main pipe is constructed in at least two separate structures, and welded areas and locations are increased compared to conventional areas and locations, thereby improving repetition durability (pulsation fatigue durability) against variations in internal pressure, providing a shock-absorbing effect against the injection noise of injectors, reducing the weights of injector cups and mount holders, and considerably reducing the costs of products.

According to the present invention, there is provided the structure of a GDI fuel delivery pipe, including: a main pipe configured to flow fuel through a hollow formed therein; a plurality of injector cups formed in cylindrical shapes having open lower ends, and configured to be coupled and fastened to the main pipe through the outside surfaces thereof, to flow fuel, entering into the main pipe, therethrough through the side surfaces thereof, and to be coupled to respective injectors adapted to selectively inject fuel at the lower ends thereof; a plurality of mount holders configured to form tubular parts each having a bolt hole in a lengthwise direction, and to be coupled and fastened to the main pipe through the outside surfaces thereof; and fastening members configured to fasten the plurality of injector cups or mount holders to the main pipe by being coupled to the outer circumferential surface of the main pipe at both left and right ends thereof while surrounding the outer circumferences of the plurality of injector cups or mount holders.

In this case, each of the fastening members may have an inverted "U"-shaped cross section, and junction surfaces which are formed to be concave in conformity with the outer circumferential surface of the main pipe are formed at both left and right ends of each of the fastening members, respectively, which are formed in a direction in which the fastening members are coupled to the main pipe.

Furthermore, each of the fastening members may have extension portions which extend in any one direction perpendicular to a direction in which the fastening members are coupled to the main pipe and which distribute stress attributable to pulsation and vibration generated by high-pressure fuel.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
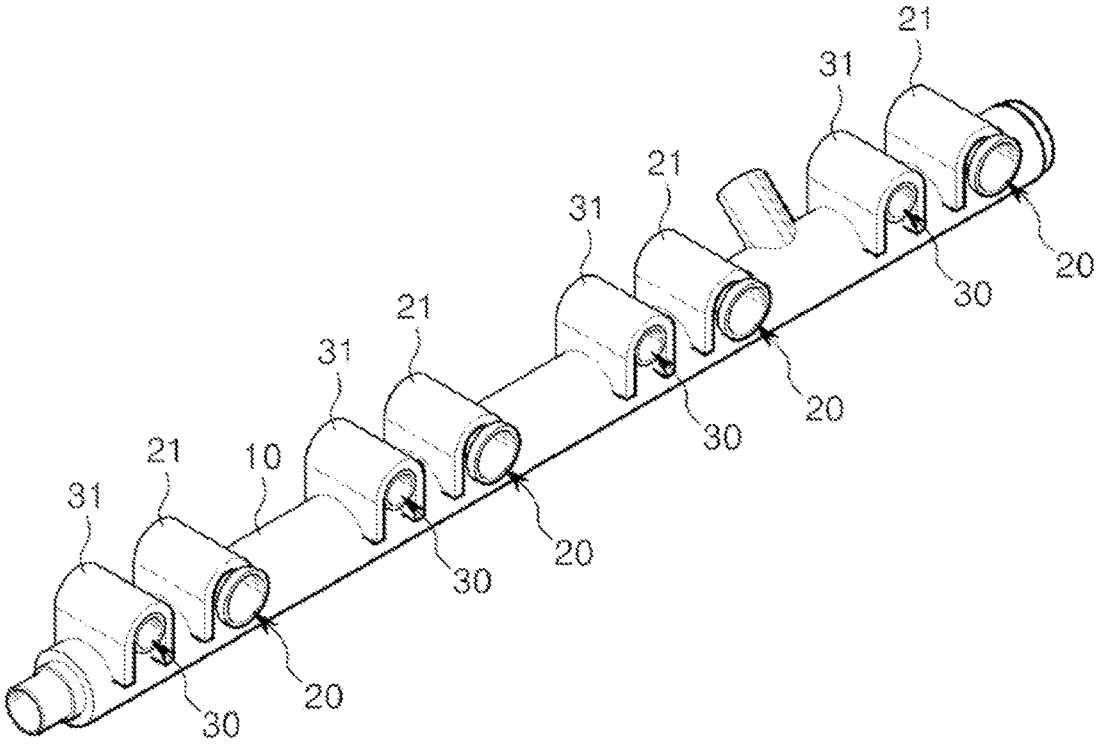
FIG. 1 is a view showing an example of the structure of a GDI fuel delivery pipe according to an embodiment of the present invention.
Figure 2:
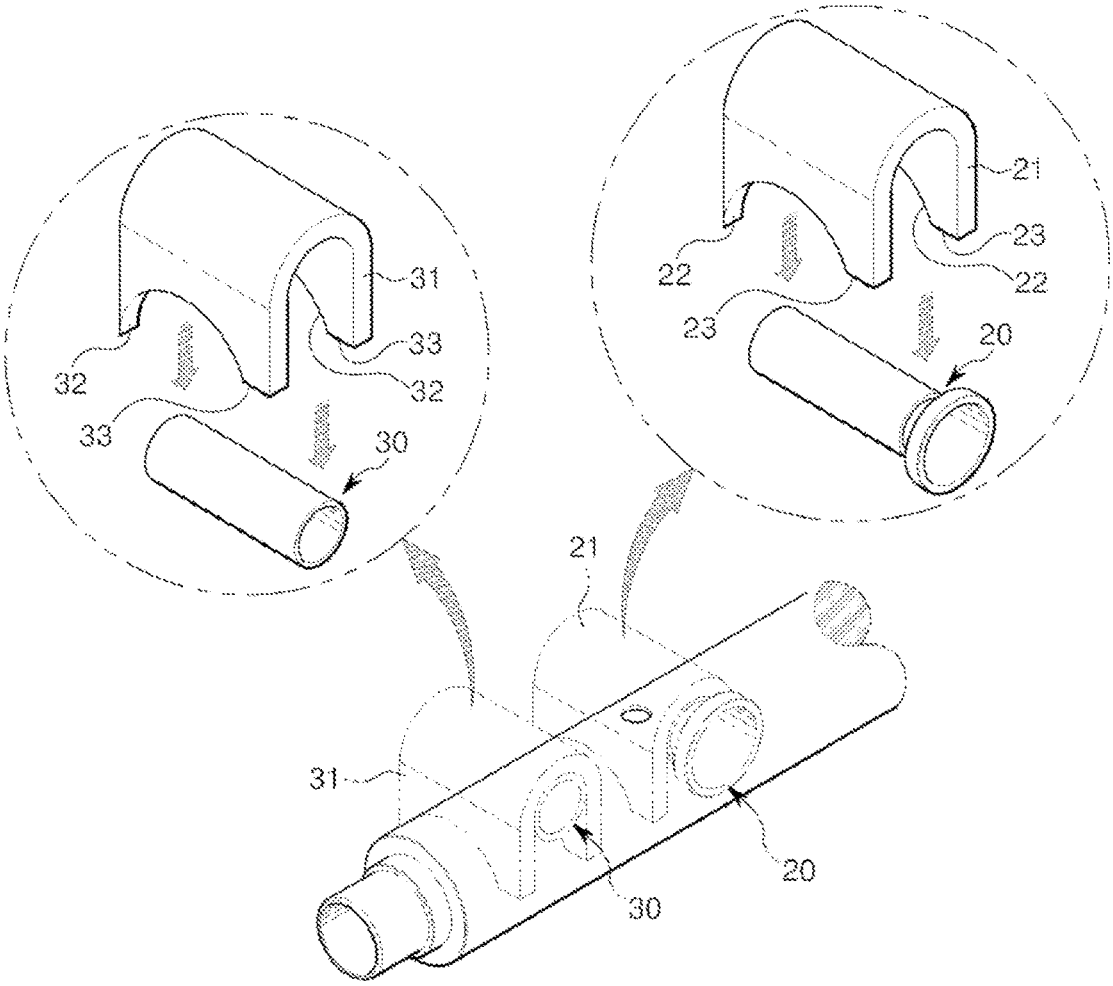
FIG. 2 is a view showing an example in which injector cups and mount holders are coupled to the main pipe of the GDI fuel delivery pipe according to the embodiment of the present invention by means of fastening members.

A preferred embodiment of the present invention will be described in detail below with reference to the accompanying drawings. Prior to the following description, it is noted that the terms or words used in the present specification and the claims should not be interpreted as being limited to common or dictionary meanings but should be interpreted as having meanings and concepts corresponding to the technical spirit of the invention based on the principle in which an inventor may appropriately define the concepts of terms in order to describe his or her invention in the best way.

Accordingly, the embodiment described in the present specification and the configurations shown in the drawings merely correspond to embodiments of the present invention and do not cover all the technical spirit of the present invention, and thus it should be appreciated that there may be various equivalents that may replace the embodiment and the configurations at the time at which the present application is filed.

First, most injection methods of gasoline engines used in conventional vehicles are of a multi-point injection (MPI) type or a port fuel injection (PFI) type.

However, recently, with the tightening of regulation on environmental pollution, regulation on the exhaust gas of vehicles has been institutionally tightened, and thus there has been a need for the development of an engine in which the pollutant content of exhaust gas is lower than that in MPI- or PBI-type engines.

To meet this need, an engine using a gasoline direct injection method has been developed. A gasoline direct injection (GDI) method is a method of directly injecting gasoline fuel into the cylinders of an engine.

In a GDI-type engine, fuel injectors configured to inject gasoline operate at a high pressure equal to or higher than 100 atmospheres, and thus it is important that design is made to prevent devices coupled to the fuel injectors from being damaged due to the use of the high-pressure fuel injectors.

A GDI fuel delivery pipe is used to supply fuel from a fuel tank to a plurality of fuel injectors and has a plurality of fuel inlets, and injector cups configured to fixedly connect the fuel injectors are installed in the respective fuel inlets.

Furthermore, the GDI fuel delivery pipe includes mount holders each configured such that a part thereof is coupled to the fuel delivery pipe and another part thereof is coupled to a corresponding injector cup in order to prevent the GDI fuel delivery pipe from being damaged due to the high-pressure injection of the corresponding fuel injector and also configured to function to prevent a coupling portion between the injector cup and the fuel delivery pipe from being damaged.

In this case, a bridge is installed between a corresponding mount holder and a corresponding injector cup, and the mount holder and the injector cup are integrated with each other by welding the mount holder and the injector cup to both sides of the bridge, respectively. In order to withstand the high pressure of a corresponding fuel injector, the areas of the portions of the bridge which are welded to the mount holder and the injector cup need to be increased, and thus the volume of the bridge needs to be increased.

When the volume of the bridge is increased, the intervals between the adjacent fuel delivery pipe, mount holder and injector cup are reduced, and thus the work of welding the bridge between the mount holder and the injector cup after welding the mount holder and the injector cup to the fuel delivery pipe becomes considerably difficult.

Furthermore, both sides of the bridge are all welded, and thus a minute crack which may occur in each welded portion grows due to the high pressure of the fuel injector and becomes a cause of damage to the fuel delivery pipe.

The present invention is directed to the structure of a gasoline direct injection (GDI) fuel delivery pipe in which each of injector cups and mount holders coupled to a main pipe is constructed in at least two separate structures, and welded areas and locations are increased compared to conventional areas and locations, thereby improving repetition durability (pulsation fatigue durability) against variations in internal pressure, providing a shock-absorbing effect against the injection noise of injectors, reducing the weights of injector cups and mount holders, and considerably reducing the costs of products. The present invention will be described in greater detail below.

A GDI fuel delivery pipe according to an embodiment of the present invention preferably includes a main pipe 10, pluralities of injector cups 20 and mount holders 30, and a plurality of fastening members 21 and 31 configured to fasten the injector cups 20 or the mount holders 30 to the main pipe 10.

First, the main pipe 10 is a tubular part having a hollow therein. Fuel enters into the main pipe 10 through one side of the main pipe 10, and flows to the other side thereof.

In this case, a plurality of holes is formed through the outer circumferential surface of the main pipe 10 at predetermined intervals in a lengthwise direction. The injector cups 20 are tightly coupled to the holes, respectively, and fuel entering into and flowing through the main pipe 10 are distributed and supplied to the plurality of injector cups 20.

In this case, each of the injector cups 20 is formed in a cylindrical shape having an open lower end, is coupled and fastened to the main pipe 10 on the outside surface thereof through welding, and is coupled to a corresponding injector configured to selectively inject fuel at the lower end thereof.

Accordingly, the injector cup 20 flows fuel, entering into the main pipe 10, thereinto through the side surface thereof, and the fuel flowing thereinto is supplied to the injector coupled to the lower end of the injector cup 20.

Furthermore, a communication hole configured to communicate with a corresponding hole of the main pipe 10 is preferably formed in a welding surface, i.e., the outer surface of the injector cup 20, which comes into tight contact with the outer circumferential surface of the main pipe 10. When the injector cup 20 is coupled to the main pipe 10, the communication hole of the injector cup 20 is disposed to come into tight contact with and communicate with the hole of the main pipe 10, and the welding surface of the injector cup 20 and the outer circumferential surface of the main pipe 10 are coupled to each other through welding (or brazing).

Furthermore, the plurality of injector cups 20 according to the embodiment of the present invention is each provided with the fastening member 21. The fastening member 21 is coupled to the outer circumferential surface of the main pipe 10 through welding at both left and right ends thereof while surrounding the outer circumference of a corresponding injector cup 20, thereby fastening the injector cup 20 to the main pipe 10.

The fastening member 21 is now described in greater detail. The fastening member 21 has an inverted "U"-shaped cross section. Junction surfaces 22 which are formed to be concave in conformity with the outer circumferential surface of the main pipe 10 are preferably formed at both left and right ends of the fastening member 21, respectively, which are formed in the direction in which the fastening member 21 is coupled to the main pipe 10.

Accordingly, in accordance with the structure of the GDI fuel delivery pipe according to the embodiment of the present invention, the elements of each of the injector cups coupled to the main pipe 10 are constructed in at least two or more structures, and thus areas and locations welded to the main pipe 10 are increased compared to conventional areas and locations, thereby improving pulsation fatigue durability, which is repetition durability against variations in internal pressure.

Furthermore, each of the fastening members 21 has extension portions 23 which extend in a downward direction perpendicular to the direction in which the fastening members 21 are coupled to the main pipe 10. The extension portions 23 distribute stress attributable to pulsation and vibration which are generated by high-pressure fuel.

Accordingly, a shock-absorbing effect is achieved in that impacts caused by the injection noise of the injectors are alleviated by the fastening members 21 and the extension portions 23 according to the embodiment of the present invention in the injector cups 20.

Furthermore, the mount holders 30 according to the embodiment of the present invention are tubular parts each having a bolt hole in a lengthwise direction, and are coupled and fastened to the main pipe 10 through the outside surfaces thereof.

In this case, a number of mount holders 30 equal to the number of injector cups 20 are preferably provided. The mount holders 30 are also coupled by the fastening members 31. The fastening members 31 couple and fasten the mount holders 30 to the main pipe 10 by being coupled to the outer circumferential surface of the main pipe 10 at both left and right ends thereof while surrounding the outer circumferences of the mount holders 30.

The fastening members 31 configured to fasten the mount holders 30 are now described in greater detail. The fastening members 31 also have an inverted "U"-shaped cross section. Junction surfaces 32 which are formed to be concave in conformity with the outer circumferential surface of the main pipe 10 are preferably formed at both left and right ends of each of the fastening members 31, respectively, which are formed in the direction in which the fastening members 31 are coupled to the main pipe 10.

Accordingly, in accordance with the structure of the GDI fuel delivery pipe according to the present invention, each of the injector cups and the mount holders coupled to the main pipe is constructed in at least two separate structures to thus distribute stress, and welded areas and locations are increased compared to conventional areas and locations, thereby improving repetition durability (pulsation fatigue durability) against variations in internal pressure, providing a shock-absorbing effect against the injection noise of injectors, reducing the weights of the injector cups and the mount holders, and considerably reducing the costs of products.

The structure of the GDI fuel delivery pipe according to the embodiment of the present invention has the following effects:

First, each of the injector cups and mount holders are constructed in the form of two or more parts, and welded areas and locations are increased compared to conventional areas and locations, thereby achieving an effect of improving repetition durability (pulsation fatigue durability) against the flow of high-pressure fuel (variations in pressure).

Second, when the injection noise of the injectors is transferred, a shock-absorbing effect is achieved in that the fastening members absorb shocks.

Third, the weights of the injector cups and the mount holders are reduced, and thus an effect is achieved in that the costs of products are considerably reduced.

Although the present invention has been described with reference to the embodiment shown in the drawings, this is merely illustrative. It will be understood by those having ordinary knowledge in the art that various modifications and other equivalent embodiments may be possible. Therefore, the true technical protection range of the present invention should be defined based on the technical spirit of the attached claims.

What is claimed is:

1. A structure of a GDI fuel delivery pipe, comprising:

a main pipe configured to flow fuel through a hollow formed therein;

a plurality of injector cups formed in cylindrical shapes having open lower ends, and configured to be coupled and fastened to the main pipe through outside surfaces thereof, to flow fuel, entering into the main pipe, through side surfaces thereof, and to be coupled to respective injectors adapted to selectively inject fuel at lower ends thereof;

a plurality of mount holders configured to form tubular parts each having a bolt hole in a lengthwise direction, and to be coupled and fastened to the main pipe through outside surfaces thereof; and fastening members configured to fasten the plurality of injector cups or mount holders to the main pipe by being coupled to an outer circumferential surface of the main pipe at both left and right ends thereof while surrounding outer circumferences of the plurality of injector cups or mount holders, wherein each of the fastening members has an inverted "U"-shaped cross section, and junction surfaces which are formed to be concave in conformity with the outer circumferential surface of the main pipe are formed at both left and right ends of each of the fastening members, respectively, which are formed in a direction in which the fastening members are coupled to the main pipe, wherein each of the fastening members has extension portions which extend in any one direction perpendicular to a direction in which the fastening members are coupled to the main pipe and which distribute stress attributable to pulsation and vibration generated by high-pressure fuel.

* * * * *